US006467376B1

(12) United States Patent
Wu

(10) Patent No.: US 6,467,376 B1
(45) Date of Patent: Oct. 22, 2002

(54) HAMMER

(76) Inventor: Li-Tu Lin Wu, No. 367, Sec. 1, Mei-Tsun Rd., Taichung (TW)

( * ) Notice: Subject to any disclaimer, the term of this patent is extended or adjusted under 35 U.S.C. 154(b) by 0 days.

(21) Appl. No.: 09/901,341

(22) Filed: Jul. 9, 2001

(51) Int. Cl.[7] ..... B25D 1/00
(52) U.S. Cl. ..... 81/22; 81/900
(58) Field of Search ..... 81/20, 22, 26, 81/27, 489, 900

(56) References Cited

U.S. PATENT DOCUMENTS 5,375,487 A * 12/1994 Zimmerman ..... 81/22
5,408,902 A * 4/1995 Burnett ..... 81/20
5,657,674 A * 8/1997 Burnett ..... 81/20

* cited by examiner

*Primary Examiner*—D. S. Meislin
(74) *Attorney, Agent, or Firm*—Pearne & Gordon LLP

(57) ABSTRACT

A hammer includes a composite material handle having a connecting portion formed on one end of the composite material handle. A head is encircled in the connecting portion of the handle and has a flat working face formed on one end. An annular groove is defined in a middle portion of the head to receive the connection portion of the handle. A through hole is transversely defined in the middle portion of the head and communicates with the annular groove. A cushion core is securely inserted in the through hole in the head to absorb the shock generated when the hammer is used.

5 Claims, 5 Drawing Sheets

HAMMER

BACKGROUND OF THE INVENTION

1. Field of the Invention

The present invention relates to a hammer, and more particularly to a hammer with a composite material handle.

2. Description of Related Art

With reference to FIG. 5, a conventional hammer in accordance with the prior art comprises a head (60) made of steel alloy and a wooden handle (50). A through hole (61) is defined in a middle portion of the head (60) and one end of the handle (50) is inserted into and securely received in the through hole (61) of the head (60). The conventional hammer has several disadvantages including the following.

1. The structure of the conventional hammer is unsteady. The head (60) may detach from the handle (50) due to the shock and vibrations of the hammer when it strikes an object. The conventional hammer can be very, dangerous.
2. The conventional hammer has no shock absorbing capability. The shock is directly transformed to a user's hand and makes the user feel uncomfortable.
3. Marking the conventional hammer is difficult. When a permanent identifying mark needs to be made on the hammer, the cost is high because the head (60) is made of steel and the handle (60) is made of wood.

The present invention has arisen to mitigate and/or obviate the disadvantages of the conventional hammer.

SUMMARY OF THE INVENTION

The main objective of the present invention is to provide a hammer with an integral or interlocking structure to make the hammer safer and that can transmit an equal or greater force to an object struck while absorbing shock normally transmitted to the user. To achieve the objective, the hammer in accordance with the present invention comprises an essentially conventional head and a composite material handle having a connecting portion formed on one end of the composite material handle. The head is encircled in the connecting portion of the handle and has a working face formed on at least one end. An annular groove is defined in a middle portion of the head to receive the connection portion of the handle. A through hole is transversely defined in the middle portion of the head and communicates with the annular groove. A cushion core is securely inserted into the through hole in the head to absorb the shock when the hammer is used to prevent the user's hand from becoming numb.

Further benefits and advantages of the present invention will become apparent after a careful reading of the detailed description with appropriate reference to the accompanying drawings.

DETAILED DESCRIPTION OF THE INVENTION

Figure 1:
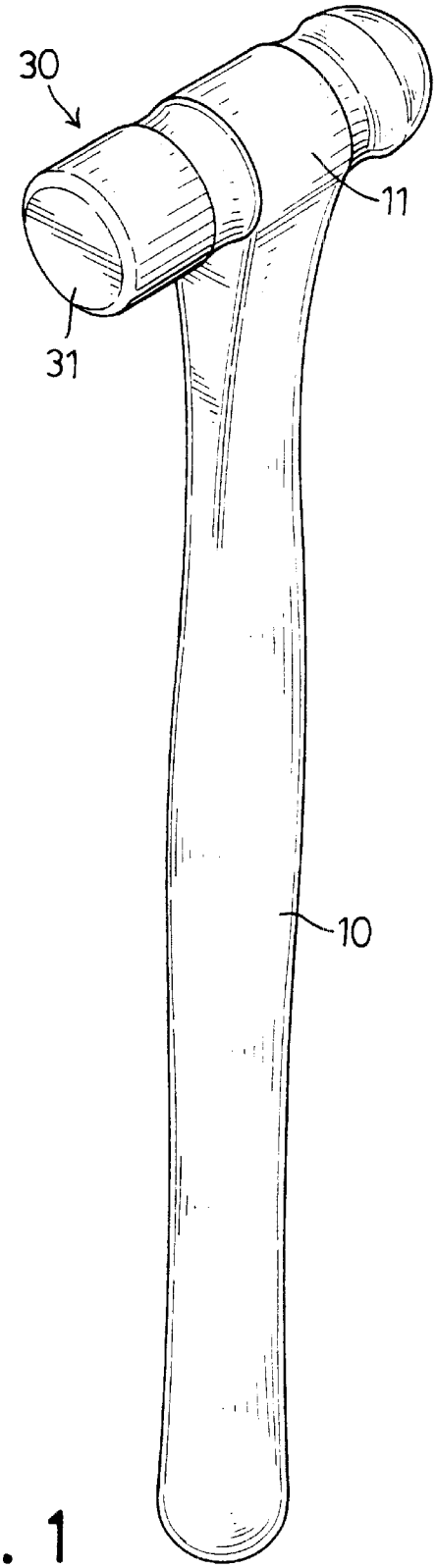
FIG. 1 is a perspective view of a hammer in accordance with the present invention.
Figure 2:
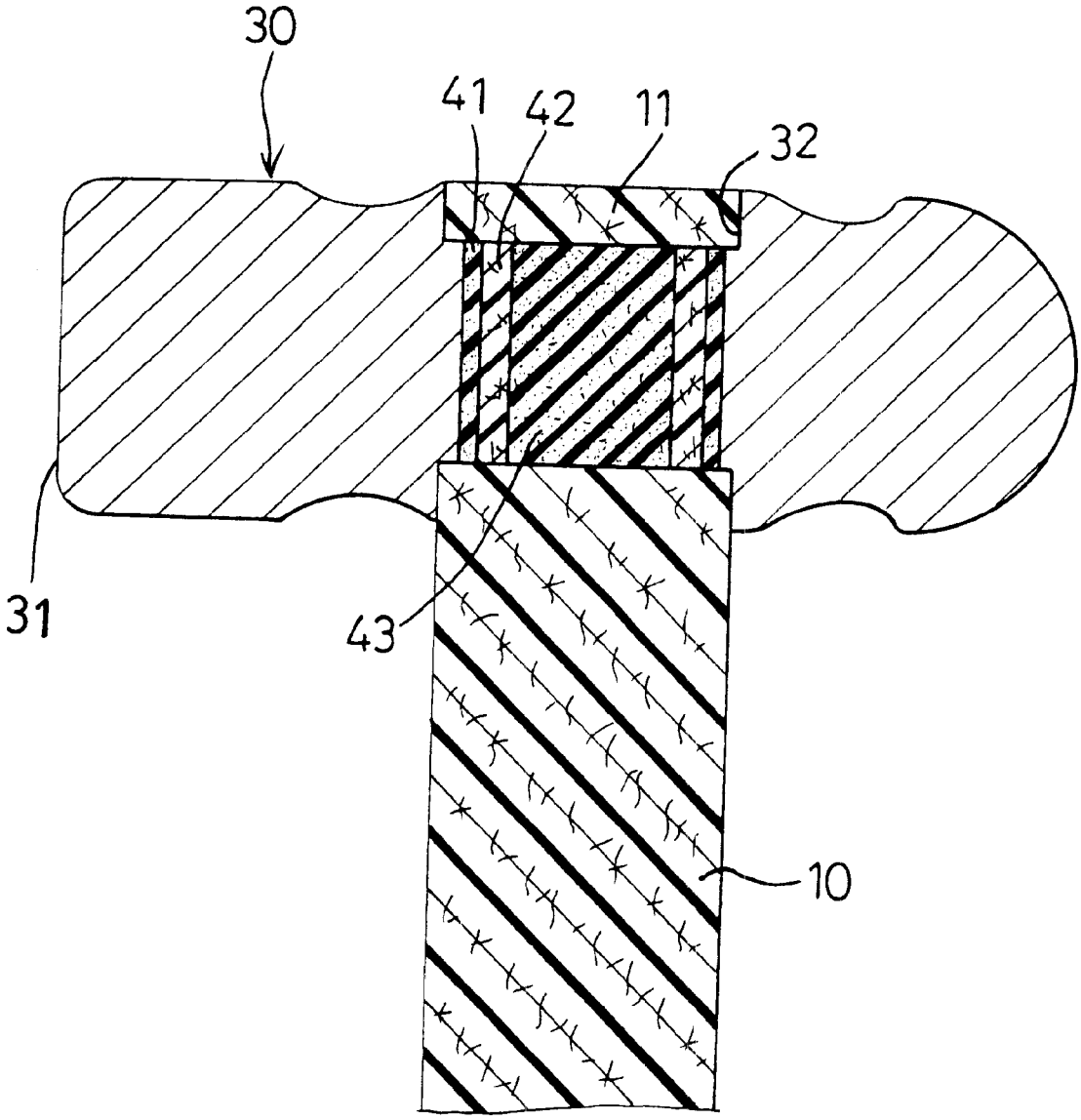
FIG. 2 is an enlarged cross sectional side plan view of the hammer in FIG. 1.
Figure 3:
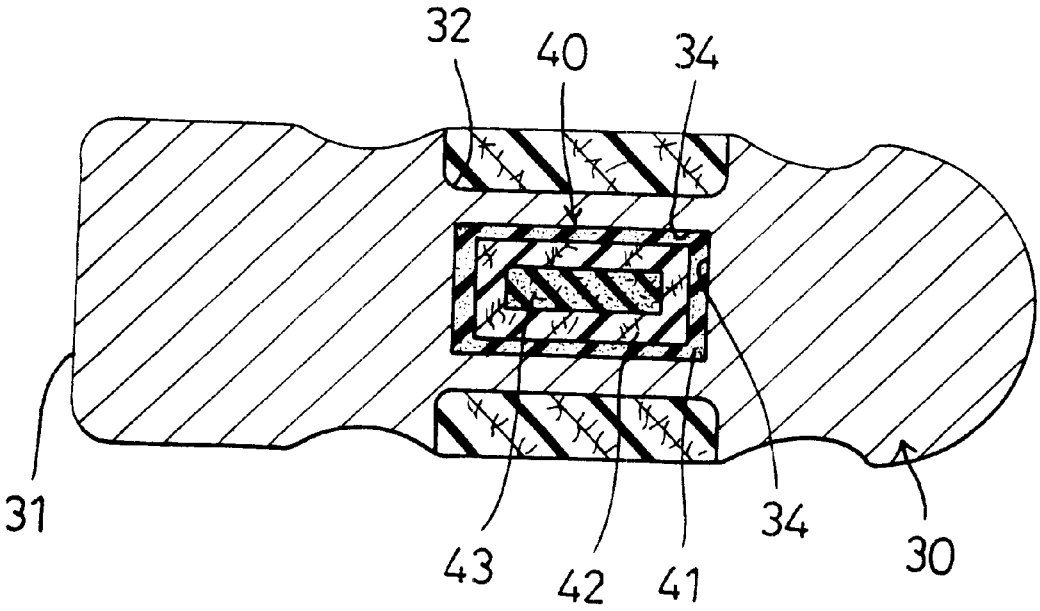
FIG. 3 is an enlarged cross sectional top plan view of the hammer in FIG. 1.

With reference to the drawings and initially to FIGS. 1–3, a hammer in accordance with the present invention comprises handle (10) and a head (30) securely attached perpendicularly to one end of the handle (10). The handle is made of composite material, such as carbon fiber or glass fiber, and the head (30) is made of steel alloy.

The head (30) includes two ends. A flat working face (31) is formed on one end, and a ball peen (not numbered) is formed on the other end. An annular groove (32) is defined in the middle portion of the head (30) and a through hole (34) is transversely formed through the head (30). The through hole (34) communicates with the annular groove (32).

A cushion core (40) is securely inserted into the through hole (34) in the head (30). The cushion core (40) comprises a foam ply (43) coated with a composite material ply (42). A cushion material ply (41) coats the composite material ply (42) after the foam material play (43) and the composite material ply (42) are combined to each other by being heated and pressed. Then one end of the handle (10) forms a connecting portion (11) to securely encircle a middle portion of the head (30) to form a T-shaped hammer and hold the cushion core (40) in place.

Figure 4:
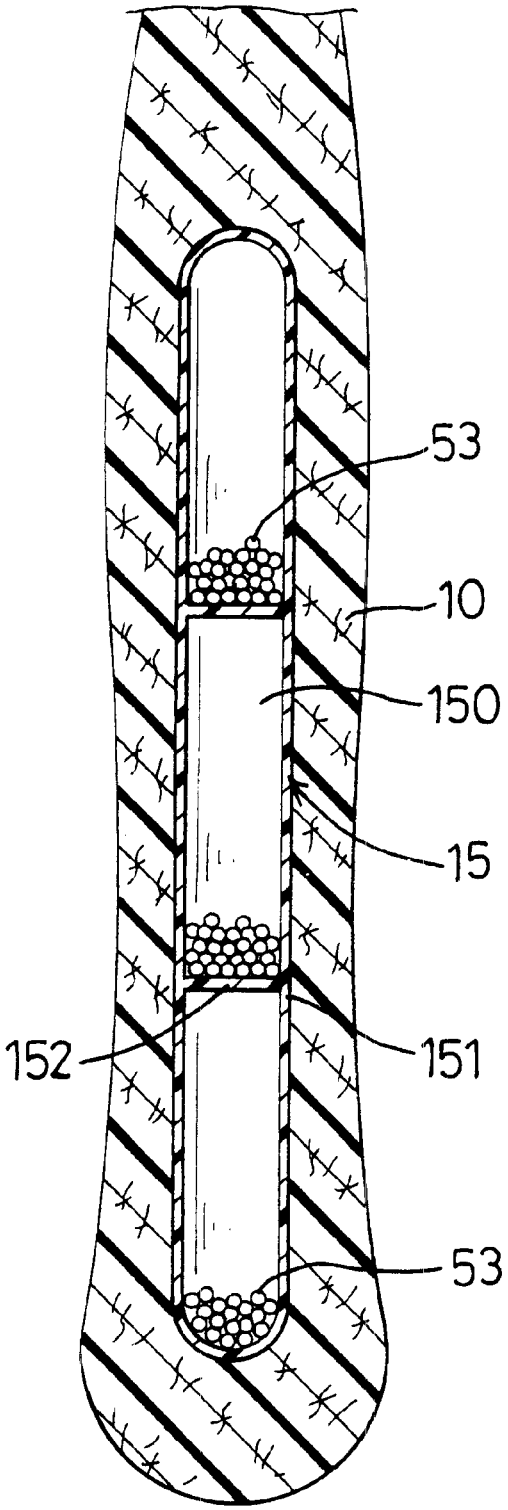
FIG. 4 is an enlarged cross sectional side plan view of a handle of the hammer in FIG. 1.
Figure 5:
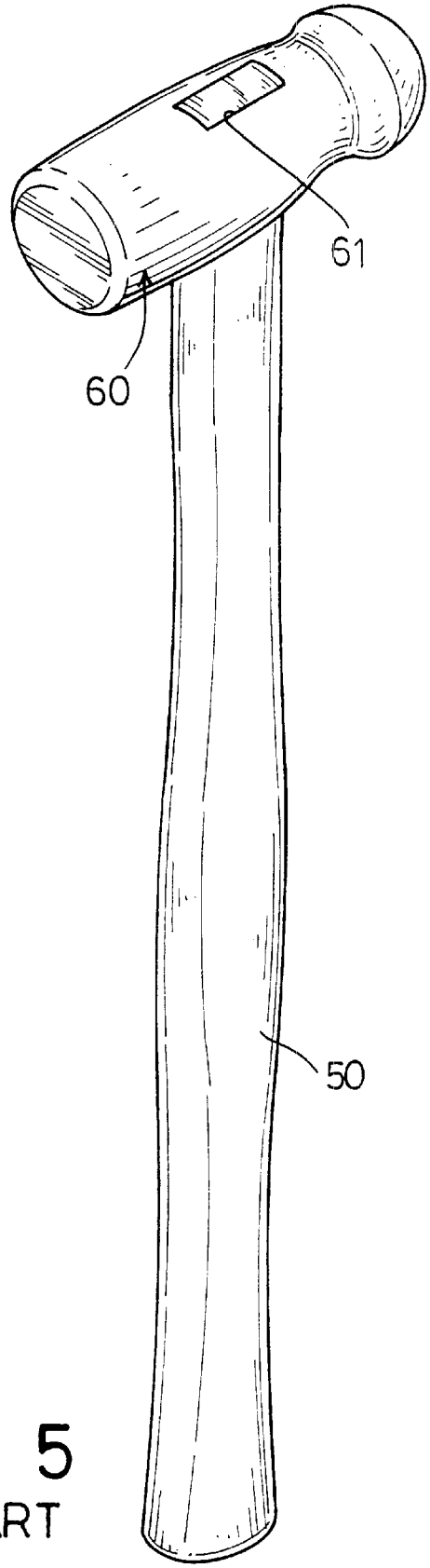
FIG. 5 PRIOR ART
FIG. 5 is a perspective view of a conventional hammer in accordance with the prior art.

With reference to FIG. 4, the hammer in accordance with the present invention further comprises a shock absorbing device (15) mounted in the handle (10). The absorbing device (15) includes a closed casing (151) and multiple partitions (152) formed to divide the casing (151) into multiple chambers (150) to loosely hold a quantity of steel balls (53) in each of the chambers (150). The steel balls (153) in the absorbing device (15) add the momentum of the moving steel balls (153) to the force of the head (30) when striking an object and can absorb the shock transmitted to the handle (10) to prevent the user's hand from becoming numb.

As described above, the hammer in accordance with the present invention includes several advantages as follow.

1. The hammer of the present invention is light and has a stronger structure because the handle of the present invention is made of composite material such as carbon fiber or glass fiber.

2. The connecting portion (11) of the handle (10) securely encircles in the groove in the head (30) by being heated and pressed so that the connection of the handle and the head is secure and effectively prevents the head (30) from detaching from the handle (10).

3. The cushion core (40) is securely mounted in the head (30) so that the shock is partially absorbed by the cushion core (40) and the absorbing device (15) is mounted in the handle (10) to absorb additional shock to prevent a user's hand from becoming numb.

4. A trademark or characters can easily be formed on the outer periphery of the handle (10) when the hammer is heated and pressed due to the characteristics of the composite material and forming method.

Although the invention has been explained in relation to its preferred embodiment, it is to be understood that many other possible modifications and variations can be made without departing from the spirit and scope of the invention as hereinafter claimed.

What is claimed is:

1. A hammer comprising:

a composite material handle having a connecting portion formed on one end of the composite material hand; and a head encircled in the connecting portion of the handle and including:

a flat working face formed on an end of the head;

an annular groove defined around a middle portion of the head to receive the connection portion of the handle;

a through hole transversely defined in the middle portion of the head and communicating with the annular groove; and a cushion core securely inserted in the through hole in the head, wherein the cushion core comprises a foam material ply, a composite material ply coated around the foam material ply, and a cushion material ply coated around the composite material ply after the foam material ply and the composite material ply have been combined with each other by being heated and pressed.

2. The hammer with a composite handle as claimed in claim 1 further comprising an absorbing device mounted in the handle and including:

a closed casing mounted in the handle;

multiple partitions formed in the closed casing to divide the closed casing into multiple chambers; and multiple steel balls in each of the chambers.

3. The hammer with a composite handle as claimed in claim 1 further comprising an absorbing device mounted in the handle and including:

a closed casing mounted in the handle;

multiple partitions formed in the closed casing to divide the closed casing into multiple chambers; and multiple steel balls in each of the chambers.

4. The hammer as claimed in claim 1, wherein the composite material handle is made of carbon fiber.

5. The hammer as claimed in claim 1, wherein the composite material handle is made of glass fiber.

* * * * *